US005699620A

United States Patent [19]

Hadtke et al.

[11] Patent Number: 5,699,620

[45] Date of Patent: Dec. 23, 1997

[54] APPARATUS FOR SHARPENING CRAYON MARKING INSTRUMENTS TO FORM AN IMPROVED ARCUATE SAFETY MARKING TIP

[75] Inventors: Frederick B. Hadtke, New Providence; Linda El-Fakir, Edison; Greg M. Rosen, Bedminster, all of N.J.

[73] Assignee: Pentech International Inc., Edison, N.J.

[21] Appl. No.: 766,536

[22] Filed: Dec. 11, 1996

[51] Int. Cl.[6] ..... B43L 23/08

[52] U.S. Cl. ..... 30/452; 30/453

[58] Field of Search ..... 30/451, 452, 453, 30/454, 455, 457, 458, 459; 144/28.1, 28.11, 28.2

[56] References Cited

U.S. PATENT DOCUMENTS

| | | | |
|---|---|---|---|
| 225,732 | 3/1880 | Suter | 30/452 |
| 299,856 | 6/1884 | Schafer | 30/451 |
| 334,242 | 1/1886 | Lamson | 30/451 |
| 355,243 | 12/1886 | Wyatt | 30/452 |
| 372,315 | 11/1887 | Halverson | 30/456 |
| 412,401 | 10/1889 | Mills et al. | 30/453 |
| 625,878 | 5/1899 | Fraser | 30/453 |
| 679,136 | 7/1901 | Anderson | 30/455 |
| 691,127 | 1/1902 | Fox . | |
| 901,622 | 10/1908 | Kann | 30/452 |
| 941,631 | 11/1909 | George . | |
| 1,026,671 | 5/1912 | Hager et al. . | |
| 1,306,903 | 6/1919 | Imaizumi | 30/452 |
| 1,451,163 | 4/1923 | Hope | 30/451 |
| 1,520,338 | 12/1924 | Dornseif . | |
| 1,560,291 | 11/1925 | Bork | 30/457 |
| 1,603,540 | 10/1926 | Holtzman | 30/452 |
| 1,770,062 | 7/1930 | Blomgren . | |
| 1,861,466 | 6/1932 | Bafetti . | |
| 1,920,957 | 8/1933 | Cassini | 30/454 |
| 2,013,538 | 9/1935 | Gamard | 30/451 |
| 2,094,494 | 9/1937 | Rago | 30/453 |
| 2,151,869 | 3/1939 | Rago | 30/453 |
| 2,279,672 | 4/1942 | Gerwig . | |
| 2,299,799 | 10/1942 | Correll | 30/457 |
| 2,409,000 | 10/1946 | Rubenstein . | |
| 2,502,177 | 3/1950 | Sigman . | |
| 2,624,316 | 1/1953 | Blanco et al. | 30/461 |
| 2,625,943 | 1/1953 | Prey . | |
| 2,642,044 | 6/1953 | Mussguller | 30/452 |
| 2,665,696 | 1/1954 | Weis | 30/451 |
| 2,691,960 | 10/1954 | Leeds et al. | 30/451 |
| 2,702,022 | 2/1955 | Fors | 30/454 |
| 2,857,881 | 10/1958 | Beebe et al. | 30/454 |
| 3,097,629 | 7/1963 | Fleming et al. | 30/454 |
| 3,242,526 | 3/1966 | Wilton et al. | 30/451 |
| 3,869,794 | 3/1975 | Smith | 30/451 |
| 3,991,798 | 11/1976 | Grosjean | 30/455 |
| 4,248,283 | 2/1981 | Kaye | 30/454 |
| 4,281,698 | 8/1981 | Mobius | 30/454 |
| 4,402,354 | 9/1983 | Halpern | 30/454 |

(List continued on next page.)

*Primary Examiner*—Hwei-Siu Payer
*Attorney, Agent, or Firm*—Sperry, Zoda & Kane

[57] ABSTRACT

A device for sharpening crayons and other soft marking instruments normally made from waxes, plastics and other soft material which includes a protective ring defining an aperture with a plurality of support members extending longitudinally therefrom. A plurality of sharpening blades extend longitudinally along the support members and are fixedly secured thereto to define a sharpening zone between the support members. Each of the sharpening blades is arcuate along its entire length extending from the protective ring to a base to which the individual support members converge. This arcuate shape is preferably of a parabolic shape to facilitate the sharpening of crayons to a blunt end shape. Debris outlets are defined between the support members and a retaining cup can be secured thereto for collecting debris. The sharpening blades are formed by blade surfaces oriented at approximately 90 degrees with respect to one another and at approximately 45 degrees with respect to the crayon marking instrument being sharpened in order to maximize sharpening and minimize any danger of accidents such as cutting of one's fingers especially by young children.

21 Claims, 4 Drawing Sheets

U.S. PATENT DOCUMENTS

| | | | |
|---|---|---|---|
| 4,513,798 | 4/1985 | Luttgens | 124/28.11 |
| 4,744,150 | 5/1988 | Horvath | 30/452 |
| 4,755,074 | 7/1988 | Roberts | 144/28.11 |
| 4,934,057 | 6/1990 | Chao | 30/454 |
| 4,991,299 | 2/1991 | Dietterich et al. | 30/453 |
| 5,002,182 | 3/1991 | McGinnis | 30/451 |
| 5,046,876 | 9/1991 | Boraca | 30/457 |
| 5,167,071 | 12/1992 | Eisen | 30/452 |
| 5,379,817 | 1/1995 | O'Neil et al. | 30/453 |

APPARATUS FOR SHARPENING CRAYON MARKING INSTRUMENTS TO FORM AN IMPROVED ARCUATE SAFETY MARKING TIP

BACKGROUND OF THE INVENTION

1. Field of the Invention

The present invention deals with the field of sharpeners used for forming the end of a writing instrument into an arcuate shape to facilitate writing and/or marking therewith. More particularly, the present invention deals with means for providing a safe apparatus for sharpening crayons and other marking instruments made from waxes, plastics and other similar soft materials to facilitate marking thereof with the marking end formed into a blunt safety rounded configuration to facilitate common uses thereof and prevent injury especially to young children who tend to use such crayons.

2. Description of the Prior Art

Numerous patents have been granted on apparatus for sharpening and otherwise handling writing instruments such as crayons and the like such as U.S. Pat. No. 225,732 patented Mar. 23, 1880 to J. Suter on a "Crayon-Sharpener"; and U.S. Pat. No. 299,856 patented Jun. 3, 1884 to T. Schafer on a "Chalk Sharpener"; and U.S. Pat. No. 334,242 patented Jan. 12, 1886 to W. H. Lamson on a "Pencil-Sharpener"; and U.S. Pat. No. 355,243 patented Dec. 28, 1886 to R. Wyatt on an "Implement For Sharpening Tailor's Chalk"; and U.S. Pat. No. 372,315 patented Nov. 1, 1887 to H. L. Halverson on a "Tailor's Crayon-Sharpening Machine"; and U.S. Pat. No. 412,401 patented Oct. 8, 1889 to G. W. Mills et al on a "Combined Crayon Sharpener, Cushion, And Weight"; and U.S. Pat. No. 625,878 patented May 30, 1899 to J. J. Fraser on a "Crayon Sharpener"; and U.S. Pat. No. 689,136 patented Jul. 23, 1901 to G. O. Anderson on a "Crayon-Sharpener"; and U.S. Pat. No. 691,127 patented Jan. 14, 1902 to A. T. Fox on a "Pencil Sharpener"; and U.S. Pat. No. 901,622 patented Oct. 20, 1908 to S. Kann on a "Crayon Sharpener"; and U.S. Pat. No. 941,631 patented Nov. 30, 1909 to R. F. George on a "Pencil-Sharpener"; and U.S. Pat. No. 1,026,671 patented May 21, 1912 to J. E. Hager et al on a "Pencil Sharpener"; and U.S. Pat. No. 1,451,163 patented Apr. 10, 1923 to A. S. Hope on a "Candle Pointer"; and U.S. Pat. No. 1,520,338 patented Dec. 23, 1924 to H. Dornseif on a "Pencil Sharpener"; and U.S. Pat. No. 1,560,291 patented Nov. 3, 1925 to O. E. Bork on a "Pencil Sharpener"; and U.S. Pat. No. 1,603,540 patented Oct. 19, 1926 to J. Holtzman and one-half assigned to Warren E. Willis on a "Crayon Sharpener"; and U.S. Pat. No. 1,770,062 patented Jul. 8, 1930 to C. H. Blomgren on a "Pencil Sharpener"; and U.S. Pat. No. 1,861,466 patented Jun. 7, 1932 to N. Bafetti on a "Crayon Holder"; and U.S. Pat. No. 2,013,538 patented Sep. 3, 1935 to D. Gamard on a "Device For Shaping Sticks Of Paint And Similar Purposes"; and U.S. Pat. No. 2,094,494 patented Sep. 28, 1937 to V. Rago on a "Tailor's Chalk Sharpener"; and U.S. Pat. No. 2,151,869 patented Mar. 28, 1939 to V. Rago on a "Tailor's Chalk Sharpener With Replaceable Blade"; and U.S. Pat. No. 2,279,672 patented Apr. 14, 1942 to O. L. Gerwig on a "Crayon Sharpener"; and U.S. Pat. No. 2,299,799 patented Oct. 27, 1942 to F. E. Correll on a "Device For Pointing Lead Pencils"; and U.S. Pat. No. 2,409,000 patented Oct. 8, 1946 to A. Rubenstein on a "Crayon"; and U.S. Pat. No. 2,502,177 patented Mar. 28, 1950 to J. J. Sigman on a "Crayon Pencil Sharpener"; and U.S. Pat. No. 2,624,316 patented Jan. 6, 1953 to E. Blanco et al on a "Crayon Sharpener"; and U.S. Pat. No. 2,625,943 patented Jan. 20, 1953 to D. A. Prey on a "Lipstick Shaper"; and U.S. Pat. No. 2,642,044 patented Jun. 16, 1953 to J. F. W. Mussguller and assigned to Klebes & Co. on a "Pencil Sharpener"; and U.S. Pat. No. 2,665,696 patented Jan. 12, 1954 to A. E. Weis on a "Combination Lipstick Applicator And Sharpener"; and U.S. Pat. No. 2,691,960 patented Oct. 19, 1954 to W. A. Leeds et al on a "Crayon Sharpener"; and U.S. Pat. No. 2,702,022 patented Feb. 15, 1955 to C. I. Fors on a "Pencil Sharpener"; and U.S. Pat. No. 2,857,881 patented Oct. 28, 1958 to H. C. Beebe et al and assigned to Binney & Smith Inc. on a "Crayon Carton And Sharpener"; and U.S. Pat. No. 3,097,629 patented Jul. 16, 1963 to J. F. Fleming et al and assigned to Sterling Plastics Co. on a "Pencil Sharpener For Cosmetic Pencils"; and U.S. Pat. No. 3,869,794 patented Mar. 11, 1975 to J. Smith on a "Candle Shaping Apparatus"; and U.S. Pat. No. 4,248,283 patented Feb. 3, 1981 to L. Kaye on a "Cosmetic Pencil Sharpener"; and U.S. Pat. No. 4,281,698 patented Aug. 4, 1981 to W. Mobius on a "Pencil Sharpener"; and U.S. Pat. No. 4,402,354 patented Sep. 6, 1983 to J. Halpern on a "Sharpener For Cosmetic Pencils"; and U.S. Pat. No. 4,513,798 patented Apr. 30, 1985 to W. Luttgens and assigned to A. Klebes GmbH & Co. K. G. Kunststoff-ung Metallwarenfabrik on a "Sharpener, Specifically For Cosmetic Sticks"; and U.S. Pat. No. 4,744,150 patented May 17, 1988 to D. Horvath on a "Container For Tape Ruler With Manual Pencil Sharpener"; and U.S. Pat. No. 4,755,074 patented Jul. 5, 1988 to M. Roberts on a "Pencil Sharpener"; and U.S. Pat. No. 4,934,057 patented Jun. 19, 1990 to W. Chao on a "Multi-Blade Pencil-Core Sharpener"; and U.S. Pat. No. 4,991,299 patented Feb. 12, 1991 to C. Dietterich et al and assigned to Binney & Smith Inc. on a "Universal Crayon Sharpener"; and U.S. Pat. No. 5,002,182 patented Mar. 26, 1991 to D. McGinnis on a "Crayon Holder And Container"; and U.S. Pat. No. 5,046,876 patented Sep. 10, 1991 to R. Boraca on a "Safety Tipped Pencil And Sharpener Therefor"; and U.S. Pat. No. 5,167,071 patented Dec. 1, 1992 to J. Eisen and assigned to Cosmolab, Inc. on a "Cosmetic Pencil Sharpener"; and U.S. Pat. No. 5,379,817 patented Jan. 10, 1995 to E. O'Neil et al on a "Sharpener For A Soft Element Pencil".

SUMMARY OF THE INVENTION

The present invention provides an improved apparatus for sharpening crayon marking instruments to a safe arcuate writing tip. Sharpening to a more rounded arcuate tip will minimize possible injury from more sharp pointed sharpened tips. Such marking instruments are most commonly made from waxes, plastics or other similar soft materials.

Also, the sharpener preferably includes a protective ring defining an inlet aperture oriented laterally thereacross. This inlet aperture is adapted to receive a crayon marking instrument protruding therethrough to facilitate sharpening thereof to protect children or other persons from placing their fingers through the protective ring and the inlet aperture defined therein. The protective ring is preferably of a size no greater than 0.5625 inches in diameter. With this size of aperture the more common diameters of crayons, namely, 5/16, 7/16 and 9/16 inches can be accommodated while at the same time utilizing the protective ring for preventing inadvertent accidents caused by cutting of one's fingers or the like by the apparatus of the present invention.

An inlet flange is also preferably defined fixedly secured to the protective ring and extending laterally outward therefrom to facilitate mounting of the sharpening apparatus with respect to any mounting surface. Such mounting may commonly be in a box housing for carrying crayons or may be positioned within a retaining cup used with the sharpening apparatus of the present invention for retaining debris.

A plurality of support members are preferably fixedly secured to the protective ring and extend outwardly longitudinally therefrom. These support members and the protective ring together define a sharpening zone between them which is adapted to receive a crayon marking instrument therein for sharpening. Each of the support members preferably includes a proximate end fixedly attached to the protective ring means and possibly integrally formed therewith. Each support member also includes a distal end spatially disposed from the proximate end thereof. The supports members preferably are defined such as to converge with the distal end thereof closer with respect to one another than the proximate end thereof. Also preferably each pair of support members cooperate together to define a debris outlet therebetween which allows the exiting of materials removed from the crayon marking instrument during sharpening thereof.

The present invention may further include a base member positioned spatially disposed longitudinally from the protective ring and fixedly secured to each of the distal ends of the support members. Also a plurality of main sharpening blades are included each of which is fixedly secured to one of the support members and extends therealong. These main sharpening blades preferably define arcuate cutting edges extending therealong and positioned adjacent the sharpening zone to facilitate sharpening of a crayon marking instrument positioned therewithin to a more blunted curved tip to reduce the propensity for damage by users such as small children. This arcuate cutting edge is preferably arcuate along the entire length thereof and each of the arcuate cutting edges extend along the entire longitudinal length of the support members from the inlet aperture completely to the base member. This cutting blade shape has been found to provide a more blunted writing tip on a crayon-type writing instrument to minimize the danger of use thereof especially by small children.

The arcuate cutting edges of each of the main sharpening blades preferably includes a main parabolic cutting profile which extends longitudinally therealong. These main sharpening blades are preferably oriented at approximately 45 degrees with respect to a crayon marking instrument being sharpened within the sharpening zone. These blade so shaped will formed the more blunt curved writing end on a crayon which is desirable for safety considerations.

The main sharpening blades further preferably include a first blade surface and a second blade surface which intersect to form the arcuate cutting edge along the intersecting edge therebetween. The first blade surface and the second blade surface are preferably oriented with respect to one another at an angle of approximately 90 degrees.

Multiple supplementary sharpening blades are included fixedly secured with respect to the base member and extending longitudinally therefrom between each pair of adjacent main sharpening blades in the preferred configuration of the present invention. In this manner sharpening will be facilitated at the endmost portion of the crayon marking instrument. Each of these supplementary sharpening blades are secured to the base member equally spaced from each adjacent main sharpening blade in this preferred configuration. Each of the supplementary sharpening blades also extends from the base member to an intermediate longitudinal position. Each of these supplementary sharpening blades preferably includes a supplemental parabolic cutting profile extending longitudinally therealong.

The present invention further includes a mounting collar fixedly secured to the protective ring and extending laterally outwardly therefrom in surrounding relation to the support members and the main sharpening blades in such a manner as to further facilitate mounting. Also a retaining cup may be included positioned in surrounding relationship with respect to the support members and the base member and in engagement with respect to the inlet flange to define a debris retaining chamber therewithin for receiving and retaining sharpening debris. The retaining cup preferably is detachably securable with respect to the inlet flange in such a manner as to facilitate the removal of sharpening debris when accumulated within the debris retaining chamber therewithin.

It is an object of the present invention to provide an apparatus for sharpening crayon marking instruments made from waxes, plastics and other soft materials which includes forming an improved arcuate safety marking end thereon wherein capital costs of production is minimized.

It is an object of the present invention to provide an apparatus for sharpening crayon marking instruments made from waxes, plastics and other soft materials which includes forming an improved arcuate safety marking end thereon wherein maintenance requirements are minimized.

It is an object of the present invention to provide an apparatus for sharpening crayon marking instruments made from waxes, plastics and other soft materials which includes forming an improved arcuate safety marking end thereon wherein no moving parts are included.

It is an object of the present invention to provide an apparatus for sharpening crayon marking instruments made from waxes, plastics and other soft materials which includes forming an improved arcuate safety marking end thereon wherein all parts can be easily formed of a plastic material.

It is an object of the present invention to provide an apparatus for sharpening crayon marking instruments made from waxes, plastics and other soft materials which includes forming an improved arcuate safety marking end thereon wherein a crayon can conveniently be formed to a blunt bullet-nose shape.

It is an object of the present invention to provide an apparatus for sharpening crayon marking instruments made from waxes, plastics and other soft materials which includes forming an improved arcuate safety marking end thereon wherein crayons can be sharpened of any diameter as large as 9/16 inches in diameter.

It is an object of the present invention to provide an apparatus for sharpening crayon marking instruments made from waxes, plastics and other soft materials which includes forming an improved arcuate safety marking end thereon wherein shaping is performed by multiple equally spaced continuously curved cutting blades preferably three in number.

It is an object of the present invention to provide an apparatus for sharpening crayon marking instruments made from waxes, plastics and other soft materials which includes forming an improved arcuate safety marking end thereon wherein cutting can be easily formed into a rounded end configuration by utilizing cutting blades having parabolic profiles.

It is an object of the present invention to provide an apparatus for sharpening crayon marking instruments made from waxes, plastics and other soft materials which includes forming an improved arcuate safety marking end thereon wherein the cutting edges are formed by intersecting blade surfaces oriented at approximately 90 degrees with respect to one another.

It is an object of the present invention to provide an apparatus for sharpening crayon marking instruments made from waxes, plastics and other soft materials which includes forming an improved arcuate safety marking end thereon wherein the sides of the blade forming the cutting edge are oriented at approximately 45 degrees to the surface of the crayon marking instrument being cut.

It is an object of the present invention to provide an apparatus for sharpening crayon marking instruments made from waxes, plastics and other soft materials which includes forming an improved arcuate safety marking end thereon wherein a protective collar is positioned about the inlet aperture to minimize the chance of inadvertent cutting of one's fingers especially when utilized by children.

It is an object of the present invention to provide an apparatus for sharpening crayon marking instruments made from waxes, plastics and other soft materials which includes forming an improved arcuate safety marking end thereon wherein sharpening of the crayon marking instrument is performed by paring blades or scrapers rather than by cutting blades.

It is an object of the present invention to provide an apparatus for sharpening crayon marking instruments made from waxes, plastics and other soft materials which includes forming an improved arcuate safety marking end thereon wherein continuously arcuate cutting edges form a rounded smooth endmost portion of the finally sharpened crayon marking instrument.

It is an object of the present invention to provide an apparatus for sharpening crayon marking instruments made from waxes, plastics and other soft materials which includes forming an improved arcuate safety marking end thereon wherein the position of the sharpener in the side, top or bottom of the box of conventional crayons is easily achieved.

It is an object of the present invention to provide an apparatus for sharpening crayon marking instruments made from waxes, plastics and other soft materials which includes forming an improved arcuate safety marking end thereon wherein use of the crayon sharpening apparatus as a separate operating piece is possible.

It is an object of the present invention to provide an apparatus for sharpening crayon marking instruments made from waxes, plastics and other soft materials which includes forming an improved arcuate safety marking end thereon wherein the inclusion of a cup for collecting sharpened debris is optionally included.

It is an object of the present invention to provide an apparatus for sharpening crayon marking instruments made from waxes, plastics and other soft materials which includes forming an improved arcuate safety marking end thereon wherein a writing end is formed on a crayon which is highly resistant to breakage due to the removal of a minimal amount of material therein and the formation of a blunt ended tip.

It is an object of the present invention to provide an apparatus for sharpening crayon marking instruments made from waxes, plastics and other soft materials which includes forming an improved arcuate safety marking end thereon wherein a minimum amount of material is removed from a crayon during sharpening.

It is an object of the present invention to provide an apparatus for sharpening crayon marking instruments made from waxes, plastics and other soft materials which includes forming an improved arcuate safety marking end thereon wherein sharpening can be performed without completely rotating of the crayon because full sharpening is provided as long as the crayon is moved back and forth rotationally with respect to its axis through at least an angle of 60–120 degrees.

It is an object of the present invention to provide an apparatus for sharpening crayon marking instruments made from waxes, plastics and other soft materials which includes forming an improved arcuate safety marking end thereon wherein supplementary cutting means are provided in the area adjacent to the marking end of the crayon writing instrument to facilitate the removal of additional material as is normally required in this area.

It is an object of the present invention to provide an apparatus for sharpening crayon marking instruments made from waxes, plastics and other soft materials which includes forming an improved arcuate safety marking end thereon wherein the formation of a writing instrument tip which is completely curved in a parabolic shape along the entire writing endmost portion thereof is achieved for the purposes of safety.

It is an object of the present invention to provide an apparatus for sharpening crayon marking instruments made from waxes, plastics and other soft materials which includes forming an improved arcuate safety marking end thereon wherein the amount of material removed from a crayon during sharpening thereof is minimized.

It is an object of the present invention to provide an apparatus for sharpening crayon marking instruments made from waxes, plastics and other soft materials which includes forming an improved arcuate safety marking end thereon wherein jamming of a crayon within a sharpener is a problem which is minimized due to the parabolic profile of the cutting edges.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
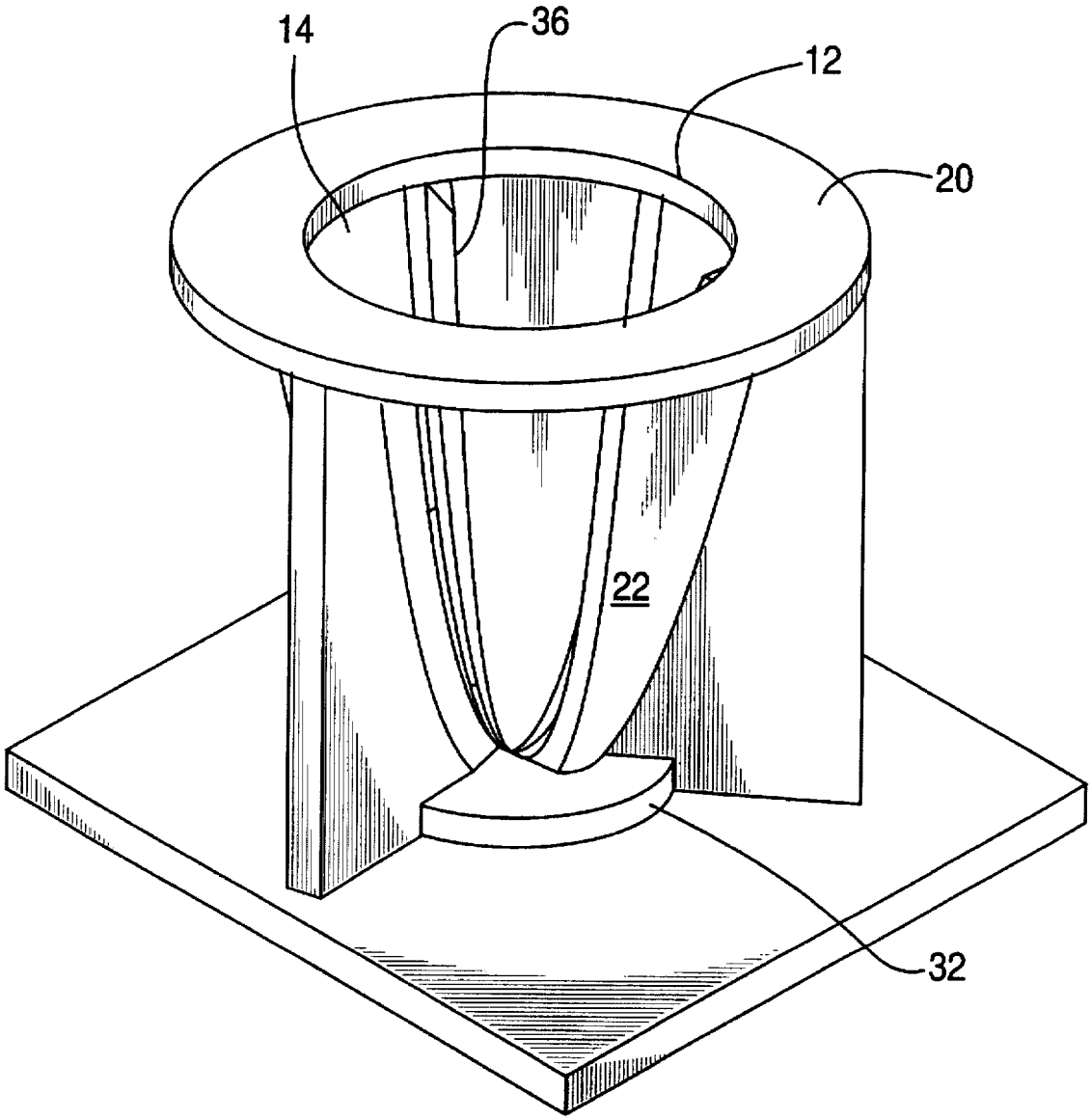
FIG. 1 is a perspective drawing of an embodiment of the apparatus for sharpening crayon marking instruments of the present invention.

The present invention provides an improved apparatus for sharpening crayon marking instruments which are commonly made from waxes, plastics and other similar soft materials into configurations with safe blunt writing tips thereon. The sharpening of such marking instruments or crayons presents significantly different problems than sharpening of a pencil in view of the fact that a pencil and the writing media contained therein are relatively hard. With a crayon-type instrument the material being sharpened is comparatively soft and a much more gentle and accurately controlled sharpening mechanism is required.

In the unique apparatus of the present invention, a protective ring 12 is included defining an inlet aperture 14 extending laterally thereacross. This inlet aperture preferably is defined to receive a crayon marking instrument 10 extending therethrough to facilitate sharpening thereof into a more blunt shaped curved writing tip. A plurality of support members 22 will extend in a longitudinal direction 18 from the protective ring 12 and will be fixedly secured thereto. The lateral direction 16 is defined to be the direction extending across the opening of the inlet aperture 14 whereas the longitudinal direction 18 extends perpendicular to a plane defined by the inlet aperture 14.

The support members 22 which extend generally longitudinally 18 away from the protective ring 12 are designed to generally converge with respect to one another and be fixedly secured with respect to a base member thereof. Each support member preferably defines a proximate end 26 which is fixedly secured to the protective ring 12 adjacent the inlet aperture 14. Also each support member 22 preferably includes a distal end 28 which is fixedly secured with respect to the base member 32 at a location spatially distant from the proximate end 26 thereof.

A plurality of main sharpening blades 34 are includes with one of each such blade fixedly secured with respect to each of the support members 22 extending longitudinally. These main sharpening blades preferably include an arcuate cutting edge 36 to facilitate forming of the more blunted writing tip preferable for use by children for the purposes of increased safety. The cutting edge 36 extends completely from the protective ring 12 to the base member 32 and is arcuate at all points along that complete distance. As such, main sharpening blades 34 provide an arcuate contour along the complete length thereof. Preferably this arcuate contour or profile is parabolic and, as such, presents a main parabolic cutting profile 38 as shown best in FIG. 2.

The parabolic shape of this profile allows the formation of a smooth curved surface along the outside of the writing end of the crayon marking instrument 10 after sharpening thereof: This allow for a crayon writing tip which is more blunted and safer for use by children and others.

Figure 4:
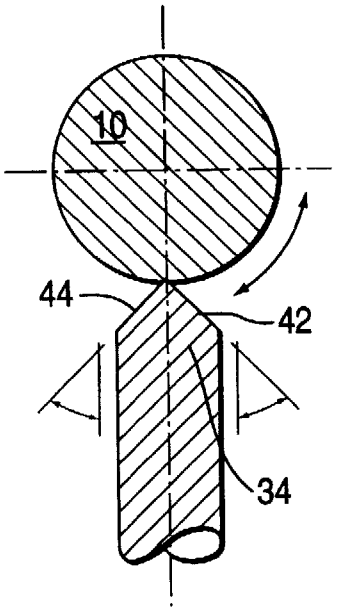
FIG. 4 is a top cross-sectional view of an embodiment of a crayon and a cutting edge showing the relative angles therebetween.
Figure 9:
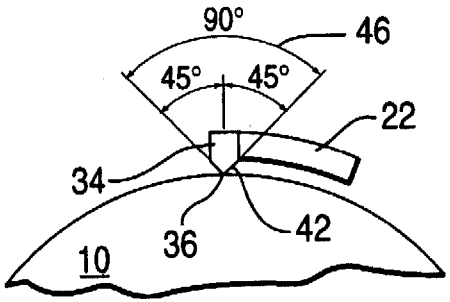
FIG. 9 is a top cross-sectional view of an embodiment of the sharpener of the present invention showing the cutting edge in contact with a crayon marking instrument for sharpening thereof illustrating the angular relationship of the cutting edges and showing the supporting position of the support member fixedly mounted with respect to an embodiment of the main sharpening blade.

As shown best in FIGS. 4 and 9, the main sharpening blade 34 will preferably include a first blade surface 42 and a second blade surface 44. Blade surfaces 42 and 44 meet to form the arcuate cutting edge 36. Preferably first blade surface 42 and second blade surface 44 are oriented at approximately a 90 degree blade surface cutting angle shown by reference 46. Also as seen particularly in FIG. 9, the first blade surface 42 as well as the second blade surface 44 will both be oriented at approximately 45 degrees with respect to the crayon marking instrument 10 and in particular with respect to a tangent along the external circular surface of the crayon marking instrument 10 taken at the point of contact of the arcuate cutting edge 36 therewith.

Figure 2:
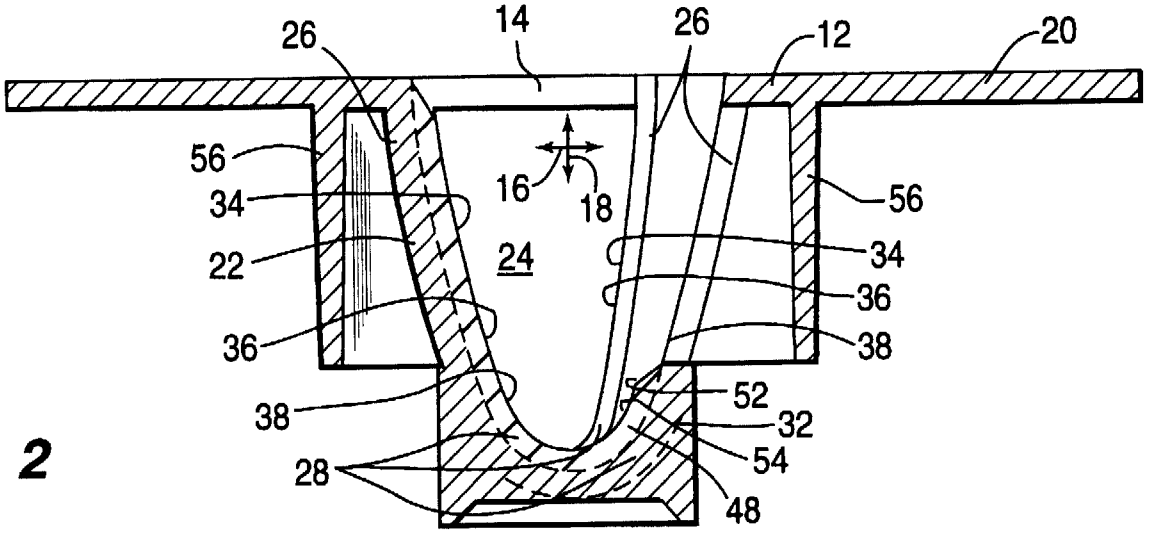
FIG. 2 is a side cross-sectional view of an embodiment of the apparatus for sharpening crayon marking instruments of the present invention.
Figure 3:
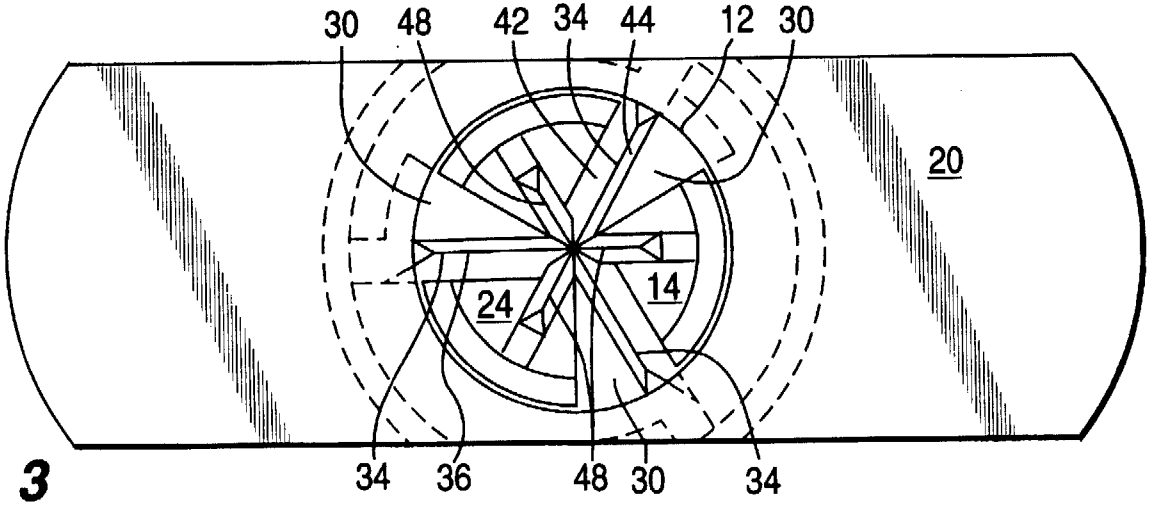
FIG. 3 is a top plan view of the embodiment shown in FIG. 2.
Figure 8:
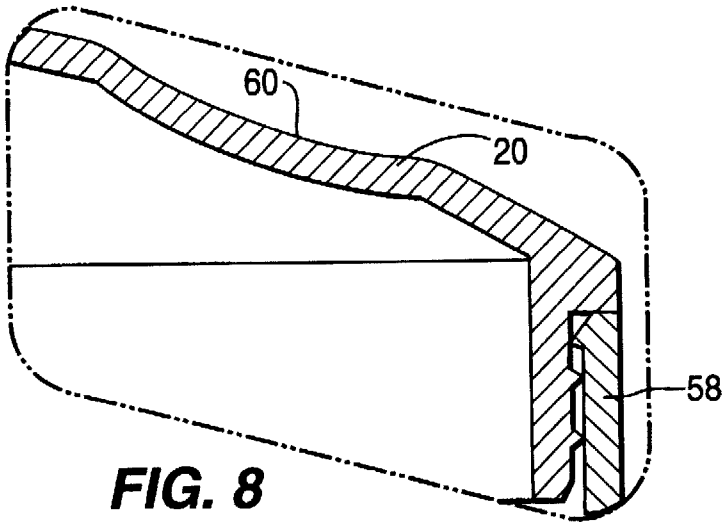
FIG. 8 is a side cross-sectional view of an embodiment of the sharpening apparatus of the present invention showing an embodiment of the means of securement between the retaining cup and the mounting collar.

When sharpening of such soft materials most of the material is removed from the endmost portion 50 of the crayon marking instrument 10 to help in removing the additional material. A plurality of supplementary sharpening blades 48 can be included. Each of these sharpening blades preferably is secured directly to the base member 32 and extends upwardly therefrom to an intermediate longitudinal position 52 similar distant from the protective ring 12. Preferably one of these supplementary sharpening blades 48 will be positioned between each adjacent pair of main sharpening blades 34. In the configuration as shown in FIGS. 1 and 2 with exactly three main sharpening blades 34 being utilized as well as three support members 22, the supplementary sharpening blades 48 will also be three in number. They will extend upwardly from the base as shown in FIG. 1 to the intermediate longitudinal position 52 and will be equally spaced between each adjacent pair of main sharpening blades 34. Preferably these supplementary sharpening blades 48 will also provide a truncated supplemental parabolic cutting profile 54 along the truncated distance thereof.

To further facilitate mounting of the sharpening apparatus of the present invention with respect to surrounding structure, a mounting collar 56 may be included. This mounting collar preferably will provide a means for facilitating mounting of the crayon sharpener apparatus of the present invention with respect to a surface such as the external surface of a crayon box or the external surface of a debris retaining chamber. The mounting collar 56 can be detachably secured with respect to a retaining cup 58 in such a manner as to define a debris retaining chamber 62 therebetween which is adapted to receive and retain debris therein. Such debris is normally expelled through the debris outlets 30 defined between each adjacent pair of support members 22.

Figure 6:
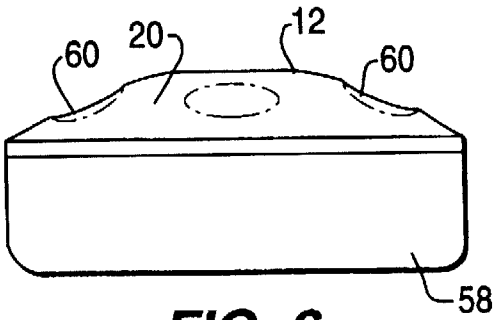
FIG. 6 is a front plan view of the embodiment shown in FIG. 5.
Figure 5:
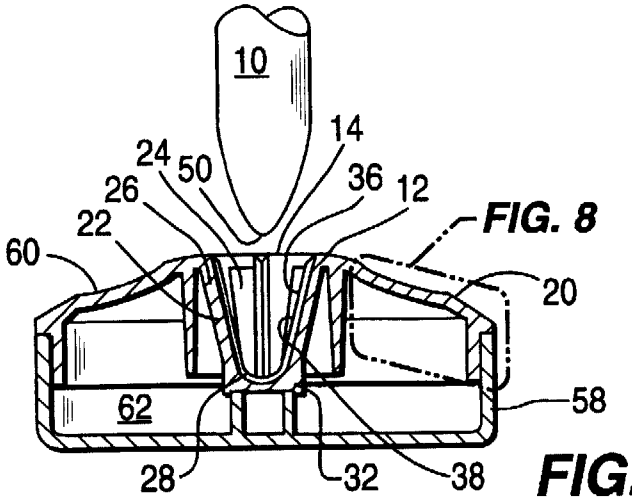
FIG. 5 is a side cross-sectional view of an embodiment of the sharpener for crayon marking instruments showing the inclusion of a retaining cup.
Figure 7:
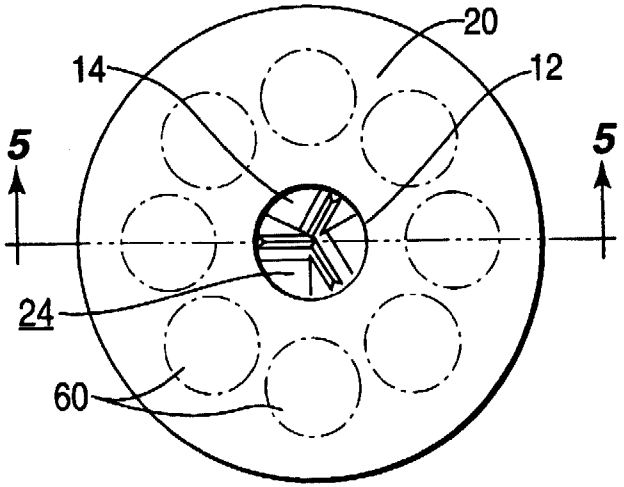
FIG. 7 is a top plan view of the embodiment shown in FIG. 6.
Figure 10:
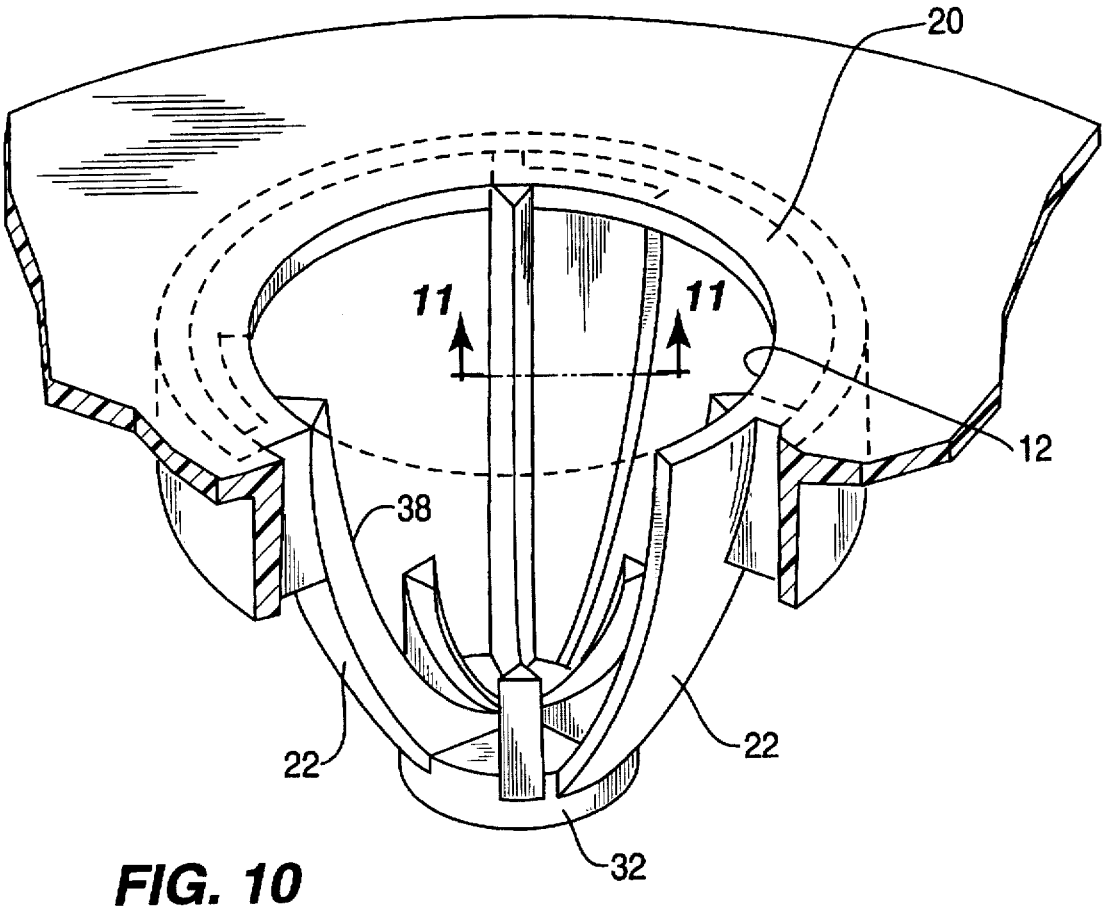
FIG. 10 is a perspective illustration of an alternative embodiment of the apparatus for sharpening crayon marking instruments of the present invention.
Figure 11:
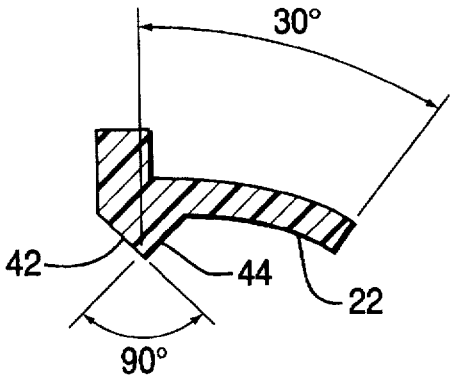
FIG. 11 is an alternative embodiment of the support wall and cutting edge of the present invention.

An inlet flange 20 may also extend laterally outwardly from the inlet aperture 14 in such a manner as to provide a wide surface to further facilitate mounting of the apparatus of the present invention with respect to a crayon box or other surface. The inlet flange 20 may also be engageable with respect to the retaining cup 58 to provide a detachable securement therewith for selectively defining a debris retaining chamber 62 defined therebetween. To facilitate grasping of the inlet flange 20 and the retaining cup 58 a plurality of dimples 60 may be positioned in the upper surface of the inlet flange 20 as shown best in FIGS. 5, 6 and 7. These dimples 60 provide an area wherein the user can exert pressure against the inlet flange 20 to facilitate retaining thereof during sharpening of a crayon marking instrument 10.

With this configuration the actual sharpening zone 24 will be defined between the individual support members 22 and between the main sharpening blades 38 defined thereon. The sharpening zone 24 will also be defined to be longitudinal from the inlet aperture 14 and actually positioned between the protective ring 12 and the base member 32.

With the configuration of the present invention preferably the protective ring 12 will be equally to or greater than 9/16 inches (0.5625 inches) in order to accommodate those different sizes of crayon marking instruments. Such crayon marking instruments are commonly available in multiple sizes, the largest of which is 9/16 of an inch. The most common sizes currently are 5/16 inch, 7/16 inchand 9/16 inch in diameter. In an aperture 14 of 0.5625 inches or greater, all of these commonly utilized sizes are accommodated. Also because of the unique arcuate and preferably parabolic shape of the cutting blades utilized in the present invention, the crayons of these various sizes will not get wedged or otherwise improperly captured within the sharpening zone 24. In fact, a full continuous rotation of the crayon marking instrument 10 within the sharpening zone 24 is not necessary to achieve full and complete sharpening. Due to the fact that the preferred configuration shown in FIGS. 1 and 2 includes three main sharpening blades 34 as well as three supplementary sharpening blades 48 positioned therebetween, it is apparent that the six blades will allow complete sharpening with a rotation of as small as 60 degrees total. Thus the back and forth rotary pivoting rather than full rotational movement of the crayon marking instrument 10 is necessary in order to achieve full sharpening thereof.

Many of the prior art devices have used very sharp blades and even razor blades to achieve proper shaping or sculpting of soft crayon material. Such is not needed and presents unnecessary dangers to the users of such sharpeners which are often young children. The present invention provides a means for providing full sharpening without requiring any slicing or cutting of the soft crayon material. The present invention merely provides a means for grinding or abrading the exterior surface of the crayon for sharpening thereof. This is achieved by the use of the first blade surface 42 and the second blade surface 44 in a relative orientation of as great as 90 degrees with respect to one another. This is also achieved by orienting these blade surfaces 42 and 44 at approximately 45 degrees with respect to the surface being cut of the soft crayon writing instrument. Thus the sharpening apparatus of the present invention is safer for use by children, but also the curved cutting blades impart a more blunted and less sharp marking tip on the crayon marking instrument thus affording even more safety when used by youngsters.

One of the primary advantages of the present invention is that a minimum amount of material is removed from the crayon during sharpening. This minimum amount of material is removed to the unique arcuate and preferably parabolic shape of the cutting edges. In this manner the crayons will last significantly longer because the tip will take on a flatly rounded bull-nose shape. Conventional crayon sharpeners have always sharpened the crayon almost to a point which removes a significant amount of material and the point of the crayon is quickly worn down thereby necessitating re-sharpening more often than when sharpening is performed with the sharpener of the present invention.

The wide cutting angles of as great as 90 degrees of the present invention are particularly responsible for the greatly reduced chance of cutting one's fingers when compared with metal blade sharpeners or sharpeners utilizing more severe angles. Also the preferably integrally molded protective ring 12 extending about the inlet aperture 14 provides a protection against the insertion of fingers into the sharpening zone 24 especially by children who commonly use crayons and crayon sharpening equipment.

By the use of arcuate and preferably parabolic cutting blades the blunt end of the crayon marking instrument will be formed into a bull-nose or arcuate shape which also is much more resistant to breakage during rough crayon use and is much safer than the more sharp writing points placed on crayons by currently used crayon sharpeners. Such rough crayon use is common among children and the tips of the crayons tend to break very easily whenever sharpened with conventional equipment. The present invention provides means for leaving a significant amount of additional material on the crayon after sharpening thereof thereby minimizing the breakage problem.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An improved apparatus for safely sharpening crayon marking instruments made from waxes, plastics and similar soft materials, said apparatus comprising:

A. a protective ring means defining an inlet aperture means oriented laterally therein and adapted to receive a crayon marking instrument extending therethrough to facilitate sharpening thereof, said protective ring means being greater than 0.5625 inches in diameter to facilitate sharpening of crayon marking instruments of difference sizes;

B. an inlet flange means fixedly secured to said protective ring means and extending laterally outwardly therefrom to facilitate mounting of the sharpening apparatus;

C. a plurality of support members fixedly secured to said protective ring means and extending outwardly longitudinally therefrom, said support members and said protective ring means defining a sharpening zone means therebetween adapted to receive a crayon marking instrument therein for sharpening thereof, each of said support members including a proximate end fixedly secured to said protective ring means and a distal end spatially disposed from said proximate end thereof, each adjacent pair of said support members cooperating together to define a debris outlet means therebetween for allowing exiting of materials removed from the crayon marking instrument during sharpening thereof;

D. a base member positioned spatially disposed longitudinally from said protective ring means and fixedly secured to each of said distal ends of said support members;

E. a plurality of main sharpening blades each of which being fixed secured to each of said support members and extending therealong, each of said main sharpening blades defining an arcuate cutting edge extending therealong and positioned adjacent said sharpening zone means to facilitate sharpening of a crayon marking instrument positioned therewithin, said arcuate cutting edges being arcuate along the entire length thereof and each of said arcuate cutting edges extending along the entire longitudinal length of its respective support member from said inlet aperture means completely to said base member, said arcuate cutting edge of each of said main sharpening blades including a main parabolic cutting profile extending longitudinally therealong, said main sharpening blades being oriented at approximately 45 degrees with respect to a crayon marking instrument being sharpened within said sharpening zone means, said support members with said main sharpening blades secured fixedly thereto extending longitudinally from said protective ring means in converging relation with respect to one another with the distal ends thereof positioned more closely with respect to one another than said proximate ends thereof, said main sharpening blades including:

(1) a first blade surface;

(2) a second blade surface intersecting with said first blade surface to form said arcuate cutting edge therebetween, said first blade surface and said second blade surface being oriented with respect to one another at an angle of approximately ninety degrees;

F. a plurality of supplementary sharpening blades each being fixedly secured to said base member and extending longitudinally therefrom between each pair of adjacent main sharpening blades to facilitate sharpening of the endmost portion of a crayon marking instrument, each of said supplementary sharpening blades being secured to said base member equally spaced from each of said main sharpening blades positioned thereadjacent, each of said supplementary sharpening blades extending from said base member to an intermediate longitudinal position, each of said supplementary sharpening blades including a supplemental parabolic cutting profile extending longitudinally therealong;

G. a mounting collar fixedly secured to said protective ring means and extending laterally outwardly therefrom in surrounding relation to said support members and said main sharpening blades to further facilitate mounting thereof; and H. a retaining cup means positioned in surrounding relationship to said support members and said base member and in engagement with respect to said inlet flange means to define a debris retaining chamber therewithin for receiving and retaining sharpening debris therein, said retaining cup means being detachably securable with respect to said inlet flange means to facilitate removal of sharpening debris from said debris retaining chamber defined therewithin.

2. An apparatus for sharpening crayon marking instruments made from waxes, plastics and other soft materials by forming an improved arcuate and blunted safety marking end thereon, said apparatus comprising:

A. a protective ring means defining an inlet aperture means oriented laterally therein and adapted to receive a crayon marking instrument extending therethrough to facilitate sharpening thereof;

B. a plurality of support members fixedly secured to said protective ring means and extending outwardly longitudinally therefrom, said support members and said protective ring means defining a sharpening zone means therebetween adapted to receive a crayon marking instrument therein for sharpening thereof, each of said support members including a proximate end fixedly secured to said protective ring means and a distal end spatially disposed from said proximate end thereof;

C. a base member positioned spatially disposed longitudinally from said protective ring means and fixedly secured to each of said distal ends of said support members;

D. a plurality of main sharpening blades each of which being fixed secured to each of said support members and extending therealong, each of said main sharpening blades defining an arcuate cutting edge extending therealong and positioned adjacent said sharpening zone means to facilitate sharpening of a crayon marking instrument positioned therewithin, said arcuate cutting edges being arcuate along the entire length thereof and each of said arcuate cutting edges extending along the entire longitudinal length of said support members from said inlet aperture means completely to said base member, said arcuate cutting edge of each of said main sharpening blades including a main parabolic cutting profile extending longitudinally therealong, said main sharpening blades being oriented at approximately 45 degrees with respect to a crayon marking instrument being sharpened within said sharpening zone means, said main sharpening blades including:

(1) a first blade surface;

(2) a second blade surface intersecting with said first blade surface to form said arcuate cutting edge therebetween, said first blade surface and said second blade surface being oriented with respect to one another at an angle of approximately sixty to ninety degrees; and E. a plurality of supplementary sharpening blades each being fixedly secured to said base member and extending longitudinally therefrom between each pair of adjacent main sharpening blades to facilitate sharpening of the endmost portion of a crayon marking instrument.

3. An apparatus for sharpening crayon marking instruments made from waxes, plastics and other soft materials by forming an improved arcuate and blunted safety marking end thereon, said apparatus comprising:

A. a protective ring means defining an inlet aperture means oriented laterally therein and adapted to receive a crayon marking instrument extending therethrough to facilitate sharpening thereof;

B. a plurality of support members fixedly secured to said protective ring means and extending outwardly longitudinally therefrom, said support members and said protective ring means defining a sharpening zone means therebetween adapted to receive a crayon marking instrument therein for sharpening thereof, each of said support members including a proximate end fixedly secured to said protective ring means and a distal end spatially disposed from said proximate end thereof;

C. a base member positioned spatially disposed longitudinally from said protective ring means and fixedly secured to each of said distal ends of said support members; and D. a plurality of main sharpening blades each of which being fixed secured to each of said support members and extending therealong, each of said main sharpening blades defining an arcuate cutting edge extending therealong and positioned adjacent said sharpening zone means to facilitate sharpening of a crayon marking instrument positioned therewithin, said arcuate cutting edges being arcuate along the entire length thereof.

4. An apparatus for sharpening crayon marking instruments made from waxes, plastics and other soft materials by forming an improved arcuate and blunted safety marking end thereon as defined in claim 1 wherein each of said arcuate cutting edges extends along the entire longitudinal length of its respective support member from said inlet aperture means completely to said base member.

5. An apparatus for sharpening crayon marking instruments made from waxes, plastics and other soft materials by forming an improved arcuate and blunted safety marking end thereon as defined in claim 1 wherein each adjacent pair of said support members cooperate together to define a debris outlet means therebetween for allowing exiting of materials removed from the crayon marking instrument during sharpening thereof.

6. An apparatus for sharpening crayon marking instruments made from waxes, plastics and other soft materials by forming an improved arcuate and blunted safety marking end thereon as defined in claim 1 wherein said arcuate cutting edge of each of said main sharpening blades includes a main parabolic cutting profile extending longitudinally therealong.

7. An apparatus for sharpening crayon marking instruments made from waxes, plastics and other soft materials by forming an improved arcuate and blunted safety marking end thereon as defined in claim 1 further comprising a plurality of supplementary sharpening blades fixedly secured to said base member and extending longitudinally therefrom between each pair of adjacent main sharpening blades to facilitate sharpening of the endmost portion of a crayon marking instrument.

8. An apparatus for sharpening crayon marking instruments made from waxes, plastics and other soft materials by forming an improved arcuate and blunted safety marking end thereon as defined in claim 7 wherein each of said supplementary sharpening blades are secured to said base member equally spaced from each of said main sharpening blades positioned thereadjacent.

9. An apparatus for sharpening crayon marking instruments made from waxes, plastics and other soft materials by forming an improved arcuate and blunted safety marking end thereon as defined in claim 7 wherein each of said supplementary sharpening blades extends from said base member to an intermediate longitudinal position.

10. An apparatus for sharpening crayon marking instruments made from waxes, plastics and other soft materials by forming an improved arcuate and blunted safety marking end thereon as defined in claim 7 wherein each of said supplementary sharpening blades includes a supplemental parabolic cutting profile extending longitudinally therealong.

11. An apparatus for sharpening crayon marking instruments made from waxes, plastics and other soft materials by forming an improved arcuate and blunted safety marking end thereon as defined in claim 1 further comprising a mounting collar fixedly secured to said protective ring means and extending laterally outwardly therefrom in surrounding relation to said support members and said main sharpening blades to further facilitate mounting thereof.

12. An apparatus for sharpening crayon marking instruments made from waxes, plastics and other soft materials by forming an improved arcuate and blunted safety marking end thereon as defined in claim 1 further comprising an inlet flange means fixedly secured to said protective ring means and extending laterally outwardly therefrom to facilitate mounting of the sharpening apparatus as desired.

13. An apparatus for sharpening crayon marking instruments made from waxes, plastics and other soft materials by forming an improved arcuate and blunted safety marking end thereon as defined in claim 12 further comprising a retaining cup means positioned in surrounding relationship to said support members and said base member and in engagement with respect to said inlet flange means to define a debris retaining chamber therewithin for receiving and retaining sharpening debris.

14. An apparatus for sharpening crayon marking instruments made from waxes, plastics and other soft materials by forming an improved arcuate and blunted safety marking end thereon as defined in claim 13 wherein said retaining cup means is detachably securable with respect to said inlet flange means to facilitate removal of sharpening debris from said debris retaining chamber defined therewithin.

15. An apparatus for sharpening crayon marking instruments made from waxes, plastics and other soft materials by forming an improved arcuate and blunted safety marking end thereon as defined in claim 12 wherein said inlet flange means includes a plurality of dimple means therein to facilitate grasping thereof during operation of the sharpening apparatus.

16. An apparatus for sharpening crayon marking instruments made from waxes, plastics and other soft materials by forming an improved arcuate and blunted safety marking end thereon as defined in claim 1 wherein said main sharpening blades are oriented at approximately 45 degrees with respect to a crayon marking instrument being sharpened within said sharpening zone means.

17. An apparatus for sharpening crayon marking instruments made from waxes, plastics and other soft materials by forming an improved arcuate and blunted safety marking end thereon as defined in claim 1 wherein said main sharpening blades include a first blade surface and a second blade surface which intersect to form said arcuate cutting edge therebetween.

18. An apparatus for sharpening crayon marking instruments made from waxes, plastics and other soft materials by forming an improved arcuate and blunted safety marking end thereon as defined in claim 17 wherein said first blade surface and said second blade surface are oriented with respect to one another at an angle of sixty to ninety degrees, inclusive.

19. An apparatus for sharpening crayon marking instruments made from waxes, plastics and other soft materials by forming an improved arcuate and blunted safety marking end thereon as defined in claim 17 wherein said first blade surface and said second blade surface are oriented with respect to one another at an angle of approximately ninety degrees.

20. An apparatus for sharpening crayon marking instruments made from waxes, plastics and other soft materials by forming an improved arcuate and blunted safety marking end thereon as defined in claim 3 wherein said support members and said main sharpening blades secured fixedly thereto extend longitudinally from said protective ring means in converging relation with respect to one another with the distal ends thereof positioned more closely with respect to one another than said proximate ends thereof.

21. An apparatus for sharpening crayon marking instruments made from waxes, plastics and other soft materials by forming an improved arcuate and blunted safety marking end thereon as defined in claim 3 wherein said protective ring means is greater than 0.5625 inches in diameter.

* * * * *

UNITED STATES PATENT AND TRADEMARK OFFICE

CERTIFICATE OF CORRECTION

PATENT NO. : 5,699,620

DATED : December 23, 1997

INVENTOR(S) : Frederick B. Hadtke, Linda El-Fakir, Greg.M. Rosen

It is certified that error appears in the above-identified patent and that said Letters Patent is hereby corrected as shown below:

In column 12, line 56, change "1" to -- 3 --.
In column 12, line 63, change "1" to -- 3 --.
In column 13, line 4, change "1" to -- 3 --.
In column 13, line 11, change "1" to -- 3 --.
In column 13, line 40, change "1" to -- 3 --.
In column 13, line 48, change "1" to -- 3 --.
In column 14, line 19, change "1" to -- 3 --.
In column 14, line 26, change "1" to -- 3 --.

Signed and Sealed this

Fourteenth Day of April, 1998

Bruce Lehman

*Attest:*

BRUCE LEHMAN

*Attesting Officer*

*Commissioner of Patents and Trademarks*